United States Patent [19]

Takata

[11] Patent Number: 4,770,340

[45] Date of Patent: Sep. 13, 1988

[54] BOILER AIR FLOW CONTROLLING APPARATUS

[75] Inventor: Nobuharu Takata, Hyogo, Japan

[73] Assignee: Mitsubishi Denki Kabushiki Kaisha, Tokyo, Japan

[21] Appl. No.: 625,248

[22] Filed: Jun. 27, 1984

[30] Foreign Application Priority Data

Jun. 28, 1983 [JP] Japan ..... 58-118982
Dec. 1, 1983 [JP] Japan ..... 58-228835

[51] Int. Cl.[4] ..... F23N 1/08
[52] U.S. Cl. ..... 236/14; 110/162; 122/DIG. 7; 236/11
[58] Field of Search ..... 236/10, 11, 1 SE, 14; 126/112; 122/DIG. 7; 110/162

[56] References Cited

U.S. PATENT DOCUMENTS 1,915,101 6/1933 Peebles ..... 236/26 B
3,214,931 11/1965 Petranek ..... 62/228.4
4,373,662 2/1983 Bassett et al. ..... 236/10

FOREIGN PATENT DOCUMENTS 0071416 2/1983 European Pat. Off. .

*Primary Examiner*—Henry A. Bennett
*Attorney, Agent, or Firm*—Bernard, Rothwell & Brown

[57] ABSTRACT

A boiler air flow controlling apparatus for feeding air in a desired air flow to a boiler by cooperation of a first fan for feeding air to the boiler with a second fan for sucking air from said boiler. The apparatus includes means for varying, when the number of poles of at least one of motors for the two fans is changed over, the opening of a damper located in an air course in order to restrict a variation of the inner pressure of the boiler upon such changing over to a value within an allowable range.

4 Claims, 3 Drawing Sheets

BOILER AIR FLOW CONTROLLING APPARATUS

BACKGROUND OF THE INVENTION

1. Field of the Invention

This invention relates to an apparatus for controlling an air flow of a boiler by controlling an air flow by at least one of a first fan for feeding air to the boiler and a second fan for sucking air from the boiler.

2. Description of the Prior Art

A fan for forcing air into a boiler or for extracting air from a boiler is driven by a variable speed electric motor in order to allow adjustment of an air flow. A pole change motor (hereinafter referred to as "PAM motor") is widely employed as a variable speed electric motor which is suitable for such applications.

FIGS. 1(*a*) and 1(*b*) are diagrammatic representations illustrating a principle of a pole change motor (PAM motor), and in those figures, reference symbols 1*a*, 1*b*, 2*a*, 2*b*, 3*a*, 3*b*, 4*a*, and 4*b* designate each a stator winding (each modelled for one phase), and reference symbol 5 designates a pole (indicated by N or S) of a rotating magnetic field.

FIG. 2 is a circuit diagram illustrating a principle of a pole change system for a PAM motor, and in this figure, reference symbol 6 designates stator windings including windings 61*a*, 61*b*, 62*a*, 62*b*, 63*a* and 63*b* and having terminals $U_1$, $U_2$, $V_1$, $W_2$, $W_1$ and $V_2$, respectively. Reference symbols 7, 8 and 9 denote each a switch, VR, VS and VT denote power supply voltages of R, S and T phases of a three-phase power source, respectively, and reference symbol o designates a neutral point of the three-phase voltages. Referring to FIG. 3, reference symbol 10 designates an electric motor, 11 a ventilator, 12 a shaft which interconnects the electric motor 10 and the ventilator (fan) 11, and 14 an air course resistance controlling mechanism including a bar 14*a* which is moved up and down to move a damper 14*b* accordingly to increase or decrease a resistance of an air course. Reference symbol 13 denotes a controlling signal which indicates an opening of the damper 14*b* necessary for the air flow resistance controlling mechanism 14, and reference symbols 15 and 16 designate an entrance and an exit of the air course, respectively.

It is to be noted that FIG. 1(*a*) is a diagrammatic representation, in a modelled form, of a pole change motor having four poles therein while the motor is used as an electric motor having six poles therein by reversing the polarity of electric currents flowing through the coils 2*b*, 3*a*, 3*b* and 4*a* which are shown in broken lines in FIG. 1(*b*). In this way, a PAM motor having variable poles therein can be obtained by changing connections of some of its stator windings to change coil currents. While FIG. 1(*a*) and 1(*b*) illustrate an example wherein the polarity of electric currents is changed, the polarity may otherwise be changed by changing phase currents.

Further, it is to be mentioned that the electric motor in FIG. 2 is run at a low speed with the switch 7 closed and with the switches 8 and 9 open, and on the contrary, it is run at a high speed with the switch 7 open and with the switches 8 and 9 closed to change the electric currents flowing through the stator windings 6 to change the number of poles of the motor.

Correspondence of the change of the number of poles between FIG. 1 and FIG. 2 will be described below. In particular, if description is given by way of an example of an electric current of the R phase, the coil 61*b* of FIG. 2 is connected between the terminal $U_2$ and the neutral point o and the direction of the electric current flowing therethrough does not change after changing of the number of poles. Accordingly, the coil 61*b* corresponds to the coil 1*a*, 1*b*, 2*a* or 4*b* of FIGS. 1(*a*) and 1(*b*). On the other hand, the coil 61*a* is connected between the terminals $U_1$ and $U_2$ and the direction of the electric current flowing therethrough changes after changing of the number of poles. Accordingly, the coil 61*a* corresponds to the coil 2*b*, 3*a*, 3*b* or 4*a* of FIGS. 1(*a*) and 1(*b*). Since the rotational frequency n of an electric motor is given by a following expression, $$n = \frac{120f}{p} \text{ [rpm]} \tag{1}$$

f: power source frequency [Hz]

p: number of poles the rotational frequency can be varied by changing the number of poles of the motor. A load to the electric motor may sometimes vary. For example, a boiler forcing fan connected to an electric motor may run under a full load in the daytime and under a low load at night. Frequently, from a point of view of saving power at night, the electric motor may be run in a lower rotational frequency (with an increased number of poles) in accordance with a low load, and in the daytime, it may be run in an increased rotational frequency (with a reduced number of poles) in accordance with a heavy load.

Thus, the rotational frequency of the PAM motor is changed by changing over of the switches 7, 8 and 9 of FIG. 2. Rotation of the PAM motor is transmitted to the ventilator (fan) 11 through a rotor of the motor 10 and the shaft 12. In this instance, a signal representative of a deviation of an actual air flow at present from a required air flow is delivered as a controlling signal 13 to the air course resistance controlling mechanism 14. The bar 14*a* is moved up or down in response to the controlling signal 13 to move the damper 14*b* accordingly to control the air flow.

Since a conventional air flow controlling apparatus is constructed as described above, when a PAM motor is to be changed over from a high speed to a low speed running or vice versa, harmonization between variation of an air flow due to variation of the rotational frequency and variation of an air flow by means of the damper 14*b* cannot be attained in a transient state in which the rotational frequency of the PAM motor varies. Accordingly, where a load to the fan is a boiler or the like, there may be a risk that a fire of the boiler during combustion goes out, a change of an internal pressure reaches a limit explosion of the boiler, and so on. Thus, the conventional air flow controlling apparatus is disadvantageous in that a PAM motor cannot be applied thereto.

In the meantime, an air flow controlling apparatus has also been put into practice wherein a motor which is driven from a variable frequency power source is employed as a motor for driving a fan in order to accomplish regulation of an air flow of the boiler as described above. In this case, the motor 10 receives supply of power alternatively from a variable frequency power source 24 (hereinafter referred to as "V power source") or a commercial power source 25 (hereinafter referred to as "C power source") depending upon open and closed conditions of the switches 21, 22 and 23. FIG. 5 illustrates operating characteristics when power supply is changed over to the C power source 25 because of a trouble of the V power source 24, and in this figure, reference symbols $t_1$, $t_2$ and $t_3$ designate a point of time at which the trouble has occurred to the V power source 24, another point of time at which the C power source 25 is coupled, and a further point of time at which rotation of the motor reaches a particular rotational frequency determined in accordance with the frequency of the C power source, respectively.

The conventional boiler air flow controlling apparatus is constructed as described above. Accordingly, the conventional boiler air flow controlling apparatus is disadvantageous in that, if a trouble occurs to the V power source and thus supply of power is changed over to the C power source, the rotational frequency of the motor (and hence the first fan 11) rises suddenly to increase an air flow while controlling of an air flow by means of the damper **14*b* is slow in responsiveness so that a wind pressure within the boiler increases to deteriorate safe running of the boiler, resulting in the necessity of tripping of the boiler. Such circumstances will be described with reference to FIG. 5**.

If a trouble occurs to the V power source (at the time $t_1$), then the rotational frequency $N_1$ of the motor (the fan) decreases and the air flow $Q_1$ by the first fan 1 decreases accordingly. At the time $t_2$ after lapse of a predetermined period of time, the motor is energized by the C power source so that the rotational frequency $N_1$ of the motor rises and the air flow $Q_1$ rises accordingly. If the inner pressure of the boiler rises higher than a predetermined level (for example, 200 mmHg), it is a dangerous range, which is in indicated by T in FIG. 5.

Accordingly, the conventional boiler air flow controlling apparatus having the construction as shown in FIG. 4 has a defect that the boiler must be tripped (stopped) at a point of time when such a dangerous range is entered.

SUMMARY OF THE INVENTION

It is an object of the present invention to provide a boiler air flow controlling apparatus of the type in which either one or both of a fan for feeding air into a boiler and another fan for sucking air from the boiler are driven from a motor the speed of which can be changed over by changing the number of poles thereof, wherein an excessive variation of an inner pressure of the boiler can be prevented even when the number of poles of the motor is changed.

According to a principle of the invention, a variation of an inner pressure of a boiler arising from a difference between two rotational speeds of a fan or fans which appears when the number of poles of the motor is changed is restricted to an allowable range by adjusting the opening of a damper located in an air course.

The present invention further provides a boiler air flow controlling apparatus which can effectively control a variation of an inner pressure of a boiler which may appear when supply of power for either one of two fans is changed over from a variable frequency power source to a commercial power source.

DESCRIPTION OF THE PREFERRED EMBODIMENTS

Now, an embodiment of the present invention will be described with reference to the accompanying drawings.

Figure 6:
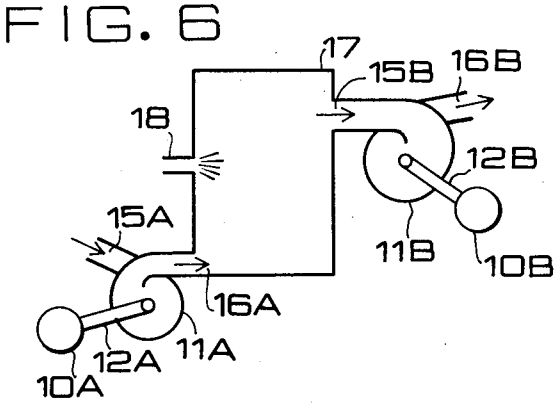
FIG. 6 is a schematic cross sectional view of an air blowing system of a boiler to which an air flow controlling apparatus according to the present invention is applied.

FIG. 6 is a diagrammatic representation showing a general construction of an air blowing system to which the present invention is applied, and reference symbols 10A and 10B designate first and second electric motors, respectively, 11A and 11B first and second fans, respectively, 12A and 12B first and second shafts, respectively, 15A and 15B air entrances of the first and second fans 11A and 11B, respectively, 16A and 16B air exits of the first and second fans 11A and 11B, respectively, reference symbol 17 designates a boiler, and 18 an ignition opening of the boiler 17. While not shown in FIG. 3, adjacent the air entrances 15A and 15B, there are located mechanisms which each correspond to the air course resistance controlling mechanism 14 of FIG. 3.

In the system of FIG. 6, it is assumed that the electric motor 10A is a PAM motor.

Figure 4:
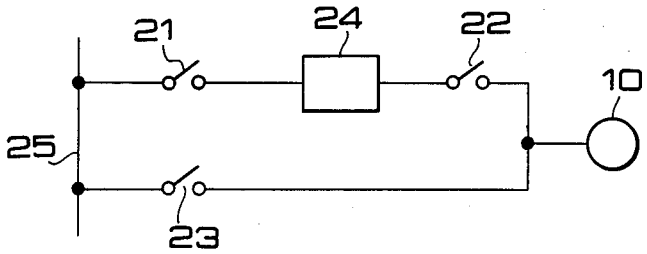
FIG. 4 is a circuit diagram showing a power supply changing over circuit for a fan motor.
Figure 5:
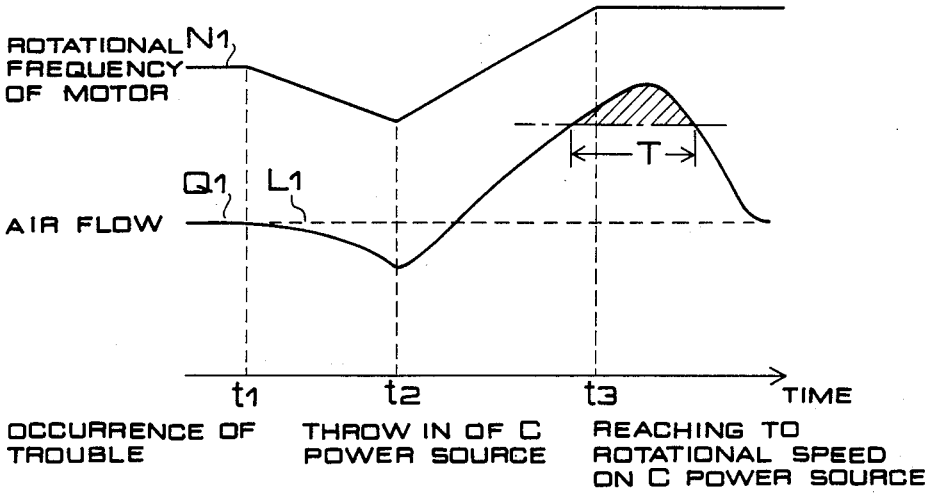
FIG. 5 is a diagram illustrating variations of a rotational frequency of the motor and an air flow when supply of power is changed over from a variable frequency power source to a commercial source by means of the changing over circuit of FIG. 4.
Figure 7:
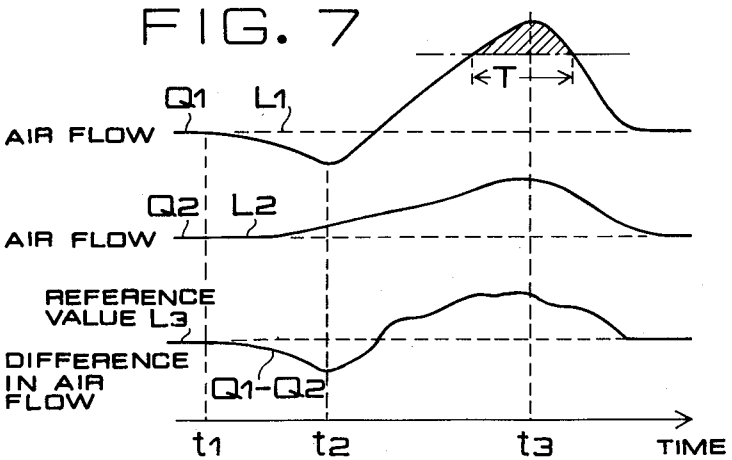
FIG. 7 is a diagram illustrating variations of an air flow when the number of poles of a pole change motor is changed over in the air flow controlling apparatus of the invention.

FIG. 7 is a diagram illustrating variations of an air flow when the PAM motor of FIG. 4 is changed over from low speed to high speed running. In FIG. 7, reference symbols $Q_1$ and $Q_2$ designate each an air flow of the fan 11A or 11B, $L_1$, $L_2$ and $L_3$ levels of the air flows $Q_1$, $Q_2$ and $Q_1-Q_2$ before a changing over operation, $t_1$, $t_2$ and $t_3$ points of time at which the motor is changed over from low to high speed running, $t_1$ being a time when application of a voltage is interrupted during running at a low speed, $t_2$ being a time when application of a voltage begins during running at a high speed, and $t_3$ being a time when a predetermined rotational frequency for the high speed is reached, and reference symbol T designates a period of time in which the air flow $Q_1$ is excessively high.

The present invention will now be described with reference to FIGS. 6 and 7.

Operations of the system when the number of poles of the PAM motor 10A of FIG. 6 is changed to change over the motor from a low to a high speed running will be described with reference to FIG. 7.

The air flow $Q_1$ of FIG. 7 first decreases since supply of a voltage during running at a low speed is interrupted (at the point of time $t_1$) to deenergize the motor until the point of time $t_2$ at which a voltage for a high speed running is supplied to the motor. Consequently, the speed of the motor rises to increase the air flow until the high speed running is reached at the point of time $t_3$. After the time $t_3$, the air flow returns to and is stabilized at the initial level $L_l$ by operation of the air course resistance controlling mechanism.

In such a case, if the air flow $Q_2$ by the fan 11B presents little variation, the air flow $Q_1-Q_2$ becomes $Q_1-Q_2=Q_1$, and thus during the excessively high air flow range T, the inner pressure of the boiler is so high that running of the boiler becomes dangerous. However, according to the present invention, in association with changing over (at the point of time $t_2$) of the PAM motor 10A from a low to a high speed running, information that a changing over instruction has been received is provided to the air course resistance controlling mechanism of the other fan 11B in order that the air flow $Q_2$ is controlled to compensate the air flow $Q_1$. As a result, the air flow $Q_1-Q_2$ does not become excessively high, and hence the boiler can be run in safety.

In the embodiment described, description has been given of an example in which the first fan 11A is driven by a PAM motor, but otherwise the second fan 11B may be driven by a PAM motor or both of the fans may be driven by respective PAM motors. Further, while the description has been given only of a case in which the motor is changed over from a low to a high speed running, it is obvious that the same applies to a reverse case in which the motor is changed over from a high to a low speed running.

It is to be noted that controlling of an air flow according to the present invention can apparently be employed together with any other air flow controlling method.

Figure 1A:
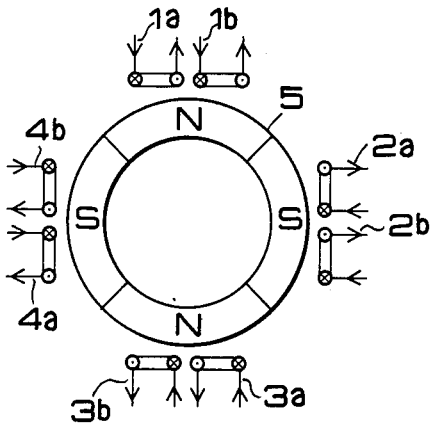
FIGS. 1(*a*) and 1(*b*) are diagrammatic representations illustrating a principle of a pole change motor.
Figure 1B:
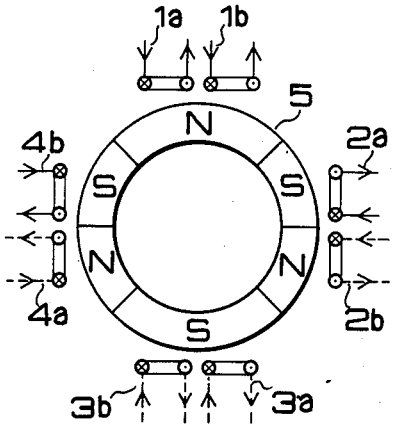
Figure 2:
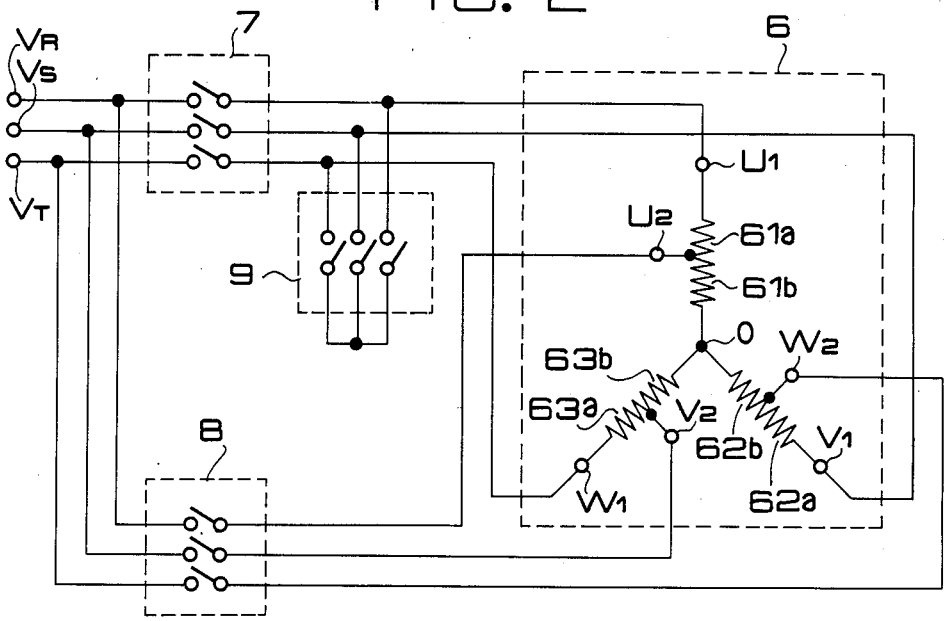
FIG. 2 is a circuit diagram showing a pole changing circuit of a pole change motor.
Figure 3:
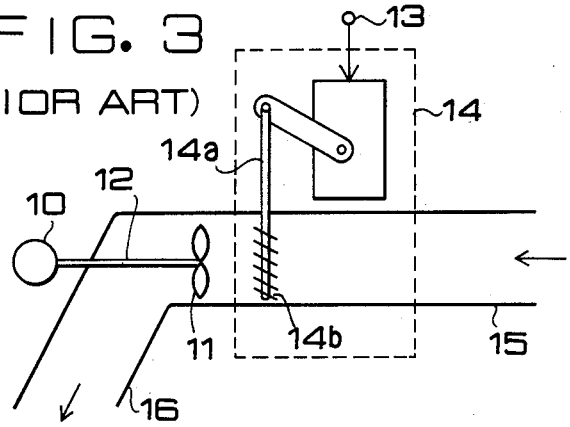
FIG. 3 (PRIOR ART)
FIG. 3 is a schematic cross sectional view of a conventional boiler air flow controlling apparatus.
Figure 8:
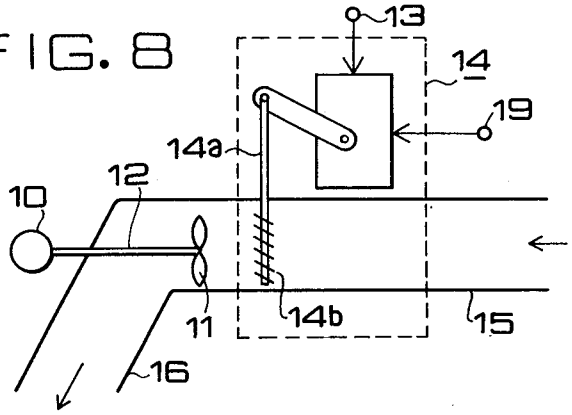
FIG. 8 is a schematic cross sectional view of part of a boiler air flow controlling apparatus of the invention.

Furthermore, the present invention also provides a boiler air flow controlling apparatus which can cope with a trouble of a V power source. Such an apparatus is illustrated in FIG. 8, in which elements corresponding to those shown in FIG. 3 are designated by like reference symbols. The air course resistance controlling mechanism 14 illustrated in FIG. 8 has an additional control input terminal 19 at which it receives, if a trouble has occurred to the V power source for the motor 10, a controlling signal for adjusting the opening of the damper **14*b*** to restrict an excessive rise of a wind pressure within the boiler.

Figure 9:
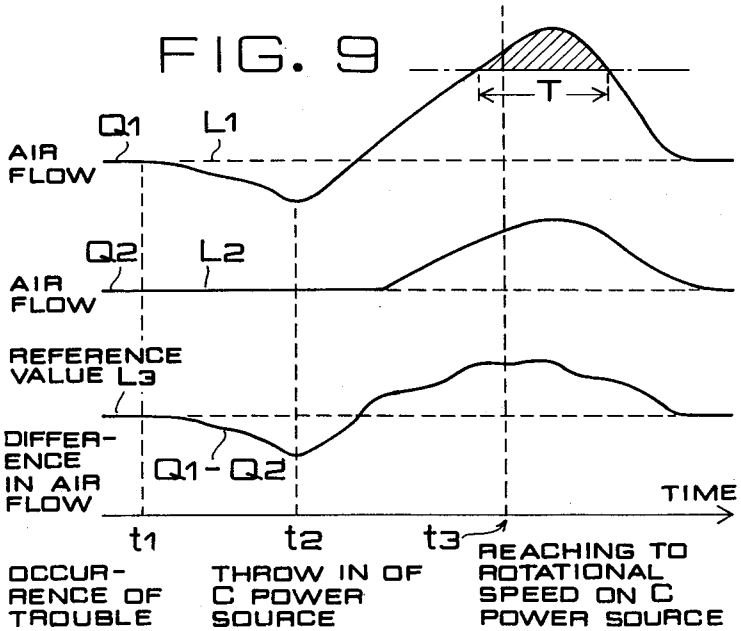
FIG. 9 is a diagram illustrating variations of an air flow when supply of power to a fan motor of the apparatus of FIG. 8 is changed over from a variable frequency power source to a commercial power source.

Conditions of controlling of a wind pressure by this apparatus are illustrated in FIG. 9. If a signal representative of a variation of an air flow corresponding to the air flow $Q_2$ is provided to the control input terminal 19 for the second fan 11B, a wind pressure within the boiler 17 is reduced to a value corresponding to the difference $Q_1-Q_2$ of the air flows which is lower than a critical wind pressure of the boiler. Ideally, the difference $Q_1-Q_2$ of the air flows should be equal to a reference value (−5 to −10 mmHg or so), but practically, it may be any value which is sufficiently below the critical wind pressure of the boiler.

The instruction regarding the air flow $Q_2$ (that is, the controlling signal delivered to the terminal 19) may be attained, for example, by an opening signal of a predetermined duration delivered to the damper of the second fan 11B and a subsequent closing signal so as to return the air flow to the level before occurrence of the trouble of the V power source, or the like.

In the embodiments described, while it has been assumed that power supply to the first fan 11A is derived from a V power source and power supply to the second fan 11B is from a C power source, the second fan 11B may otherwise be driven from a V power source. Or else, the first fan 11A and the second fan 11B may both be driven from a V power source or respective V power sources. In this instance, the controlling signal to the damper **14*b*** is replaced by a signal for varying an output frequency of the V power source.

Further, while description has been given of the examples in which an air course resistance is controlled by means of a damper, a controlling signal can be provided similarly to any other means such as a vane or the like.

Further, while the controlling input terminals 13 and 19 of the air course resistance controlling mechanism 14 of FIG. 8 are shown separately in order to give definite description, a signal delivered to the controlling input terminal 19 may be provided also to the other controlling input terminal 13.

It is to be noted that an air flow controlling apparatus according to the present invention may naturally be used together with any other air flow controlling system.

As apparent from the foregoing description, according to the present invention, when a PAM motor of one of air flow controlling systems is to be changed over from a high to a low speed running or vice versa, the other air flow controlling system is first rendered operative prior to the operation of the one air flow controlling system. Accordingly, the present invention presents an effect that running of a boiler can be continued with the inner pressure of a boiler furnace maintained in safety.

In addition, when a trouble occurs to a V power source for driving either one of two fans, supply of power is changed over from the V power source to a C power source and controlling of an air flow by means of the other fan is effected positively. Accordingly, the present invention presents another effect that, even upon occurrence of a trouble to the V power source, running of a boiler can be continued without stopping (tripping) of the boiler.

What is claimed is:

1. A boiler air flow controlling apparatus of the type which includes a first fan for feeding air to a boiler, and a second fan for sucking air from said boiler, and wherein one of said first and second fans is driven by a variable speed electric motor the speed of which can be varied by changing the number of poles in accordance with a load applied thereto, said boiler air flow controlling apparatus comprising means for providing, when the rotational speed of said variable speed electric motor for driving said one of said first and second fans is to be changed by changing the number of poles, to the other one of said first and second fans an air flow varying controlling instruction for varying an air flow of said other fan in advance of variation in air flow of said one fan.

2. A boiler air flow controlling apparatus according to claim 1, wherein said means for providing an air flow varying controlling instruction to said the other fan provides a preceding instruction to an electric motor which drives said the other fan such that the inner pressure of said boiler is kept within a predetermined range even after the speed of said electric motor which drives said one fan has been changed over.

3. A boiler air flow controlling apparatus according to claim 1, wherein said variable speed electric motor is a pole change motor.

4. A boiler air flow controlling apparatus of the type which includes a first fan for feeding air to a boiler, a second fan for sucking air from said boiler, one of said first and second fans being driven by an electric motor to which power is supplied from a variable frequency power source, and means for changing over supply of power to said electric motor from said variable frequency power source to a commercial power source when a trouble has occurred to said variable frequency power source, said boiler air flow controlling apparatus comprising means responsive to changing over of the power supply to said electric motor from said variable speed power source to said commercial power source for providing to the other one of said first and second fans an air flow varying instruction for varying the air flow by said the other fan in advance of increase in air flow of said one fan.

* * * * *

UNITED STATES PATENT AND TRADEMARK OFFICE

CERTIFICATE OF CORRECTION

PATENT NO. : 4,770,340

DATED : September 13, 1988

INVENTOR(S) : Nobuharu Takata

It is certified that error appears in the above-identified patent and that said Letters Patent is hereby corrected as shown below:

Column 2, line 53, after "limit" insert --that may result in--.

Column 3, line 25, after "first fan" cancel the numeral "1" and insert the numeral --11--;

line 31, after "is" insert --in--;

line 32, after "is" cancel the word "in".

Column 4, line 40, cancel the numeral "3," and insert the numeral --6,--.

Signed and Sealed this

Eighth Day of August, 1989

*Attest:*

*Attesting Officer*

DONALD J. QUIGG

*Commissioner of Patents and Trademarks*